US011640139B2

(12) United States Patent
Huot-Marchand

(10) Patent No.: US 11,640,139 B2
(45) Date of Patent: May 2, 2023

(54) HOROLOGICAL REGULATOR MECHANISM WITH HIGH QUALITY FACTOR AND MINIMAL LUBRICATION

(71) Applicant: ETA SA Manufacture Horlogere Suisse, Grenchen (CH)

(72) Inventor: Sylvain Huot-Marchand, Eschert (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 343 days.

(21) Appl. No.: 16/999,584

(22) Filed: Aug. 21, 2020

(65) Prior Publication Data

US 2021/0055695 A1 Feb. 25, 2021

(30) Foreign Application Priority Data

Aug. 22, 2019 (EP) ..... 19193107

(51) Int. Cl.

| | |
|---|---|
| ***G04B 13/02*** | (2006.01) |
| ***G04B 15/08*** | (2006.01) |
| ***G04B 15/14*** | (2006.01) |
| ***G04B 18/02*** | (2006.01) |

(52) U.S. Cl.

CPC ..... *G04B 13/022* (2013.01); *G04B 15/08* (2013.01); *G04B 15/14* (2013.01); *G04B 18/02* (2013.01)

(58) Field of Classification Search

CPC ..... G04B 13/022; G04B 15/08; G04B 15/14; G04B 18/02

See application file for complete search history.

(56) References Cited

U.S. PATENT DOCUMENTS

| | | | | |
|---|---|---|---|---|
| 4,346,049 | A | 8/1982 | Coppola et al. | |
| 4,853,299 | A * | 8/1989 | Mizutani | C04B 35/565 264/DIG. 36 |
| 6,755,566 | B2 | 6/2004 | Damasko | |

(Continued)

FOREIGN PATENT DOCUMENTS

| | | | |
|---|---|---|---|
| CH | 702 930 | A2 | 10/2011 |
| CN | 1646448 | A | 7/2005 |

(Continued)

OTHER PUBLICATIONS

Combined Chinese Office Action and Search Report dated Feb. 24, 2022 in Chinese Patent Application No. 202010849257.X (with English translation of Category of Cited Documents), 13 pages.

(Continued)

*Primary Examiner* — Edwin A. Leon
*Assistant Examiner* — Kevin Andrew Johnston
(74) *Attorney, Agent, or Firm* — Oblon, McClelland, Maier & Neustadt, L.L.P.

(57) ABSTRACT

A horological regulator mechanism including a resonator mechanism having a virtual pivot and flexure bearing, with a quality factor greater than 1,000, the inertial element whereof indirectly cooperates with a free escapement mechanism, during the operating cycle whereof the resonator mechanism has at least one phase of freedom wherein it is not in contact with the escapement mechanism, this regulator mechanism comprises a pair of components including rubbing surfaces arranged to cooperate and be in contact with one another, whereby the first rubbing surface is formed by the surface of an element comprising silicon carbide.

11 Claims, 3 Drawing Sheets

(56) References Cited

U.S. PATENT DOCUMENTS

| | | | | |
|---|---|---|---|---|
| 2002/0114225 | A1 | 8/2002 | Damasko | |
| 2010/0214880 | A1* | 8/2010 | Rappo | G04D 3/0069 216/99 |
| 2012/0307601 | A1 | 12/2012 | Kruttli | |
| 2015/0331391 | A1* | 11/2015 | Dubois | G04B 13/027 29/896.3 |
| 2018/0372150 | A1 | 12/2018 | Papi et al. | |
| 2019/0243308 | A1* | 8/2019 | Winkler | G04B 15/14 |
| 2019/0271945 | A1 | 9/2019 | Winkler et al. | |
| 2019/0278227 | A1 | 9/2019 | Winkler et al. | |
| 2019/0302695 | A1 | 10/2019 | Winkler et al. | |
| 2019/0369559 | A1 | 12/2019 | Winkler et al. | |

FOREIGN PATENT DOCUMENTS

| | | | | |
|---|---|---|---|---|
| CN | 105093897 | A | 11/2015 | |
| CN | 105093898 | A | 11/2015 | |
| CN | 105319938 | A | 2/2016 | |
| CN | 109814364 | A | 5/2019 | |
| CN | 109983409 | A | 7/2019 | |
| EP | 0 665 196 | A1 | 8/1995 | |
| EP | 732635 | A1 * | 9/1996 | B81C 99/008 |
| EP | 2 472 340 | A1 | 7/2012 | |
| EP | 2472340 | A1 * | 7/2012 | B81B 3/0075 |
| EP | 2 553 532 | B1 | 2/2013 | |
| EP | 3 182 213 | A1 | 6/2017 | |
| EP | 3 182 213 | B1 | 6/2017 | |
| EP | 3182213 | A1 * | 6/2017 | F16C 11/12 |
| EP | 3 327 515 | A1 | 5/2018 | |
| JP | 60-186467 | A | 9/1985 | |
| JP | 60-246263 | A | 12/1985 | |
| JP | 2015-219242 | A | 12/2015 | |
| TW | I654504 | B | 3/2019 | |

OTHER PUBLICATIONS

Advanced Ceramic Material, Mar. 31, 2015, 28 pages.

Combined Taiwanese Office Action and Search Report dated Apr. 28, 2021 in corresponding Taiwanese Patent Application No. 109120813 (with English Translation of Category of Cited Documents), 9 pages.

Combined Chinese Office Action and Search Report dated Jul. 5, 2021 in Chinese Patent Application No. 202010849257.X (with English translation of Category of Cited Documents), 14 pages.

Japanese Office Action dated Jul. 6, 2021 in Japanese Patent Application No. 2020-124265 (with English translation), 9 pages.

Korean Office Action dated Sep. 9, 2021 in Korean Patent Application No. 10-2020-0085526 (with English translation), 13 pages.

Combined Chinese Office Action and Search Report dated Feb. 24, 2022 in Chinese Patent Application No. 202010849257.X (reference previously filed, now submitting English translation only), 12 pages.

European Search Report dated Jan. 31, 2020 in European Application 19193107.0 filed Aug. 22, 2019 (with English Translation of Categories of Cited Documents), 5 pages.

* cited by examiner

HOROLOGICAL REGULATOR MECHANISM WITH HIGH QUALITY FACTOR AND MINIMAL LUBRICATION

CROSS-REFERENCE TO RELATED APPLICATION

This application claims priority to European Patent Application No. 19193107.0 filed on Aug. 22, 2019, the entire disclosure of which is hereby incorporated herein by reference.

FIELD OF THE INVENTION

The invention relates to a horological regulator mechanism comprising, arranged to be disposed on a plate, a resonator mechanism having a quality factor greater than 1,000, and an escapement mechanism which is arranged to be subjected to a torque from drive means comprised in a movement, said resonator mechanism comprising an inertial element arranged to oscillate relative to said plate, said inertial element being subjected to the effect of elastic return means arranged to be attached directly or indirectly to said plate, and said inertial element being arranged to indirectly cooperate with an escape wheel set comprised in said escapement mechanism, said regulator mechanism comprising at least one pair of components comprising a first component and a second component respectively comprising a first rubbing surface and a second rubbing surface which are arranged to cooperate and be in contact with one another.

The invention further relates to a horological movement comprising such a regulator mechanism.

The invention further relates to a watch comprising such a movement and/or such a regulator mechanism.

The invention further relates to a method for producing such an escapement mechanism.

The invention relates to the field of horological mechanisms comprising components in constant motion, and more particularly the field of escapement mechanisms.

BACKGROUND OF THE INVENTION

Timepiece manufacturers have constantly endeavoured to improve the dependability of movements by reducing the frequency of servicing operations, while ensuring that the horological movements run in a precise manner.

The lubrication of the moving components and wheel sets is a problem with no easy solution. Lengthy tribological testing is required to develop solutions for simplifying lubrication or even eliminating the need therefor.

More particularly, lubrication-free operation of the escapement mechanisms is sought, by attempting to define pairs of materials rubbing against one another that have a low and stable coefficient of friction, as well as low wear and excellent resistance over time.

Many current mechanical watches are provided with a sprung balance resonator, which constitutes the time base of the movement, and associated with an escapement mechanism, generally a Swiss lever escapement mechanism. This escapement performs two main functions:

- it maintains the back and forth movements of at least one inertial mass, typically a balance, comprised in the resonator;
- and it counts these back and forth movements.

In addition to these two main functions, the escapement must be robust, able to withstand impacts, and not block the movement (overbanking). The Swiss lever escapement mechanism has a low energy efficiency (about 30%). This low efficiency is a result of the fact that the escapement movements are jerky, that there are drops or backlashes to compensate for machining errors, and is also a result of the fact that a plurality of components transmit their movement to one another via inclined planes which rub against one another.

At least one inertial element, a guiding means and an elastic return means are required to constitute a mechanical resonator. Conventionally, a spiral spring acts as an elastic return element for the inertial element constituted by a balance.

When the inertial mass is guided such that it rotates by pivots which rotate within smooth ruby bearings, this causes friction, and thus results in energy losses and running disturbances, which depend on the positions of the watch in space relative to the gravitational field, and which are sought to be eliminated.

A new generation of mechanical resonators comprises, in connection to the inertial element, at least two flexure elements which perform the two pivot guiding and elastic return means functions. These new resonators allow for higher oscillation frequencies, in the order of 10 Hz, or even 50 Hz or more, and much higher quality factors, often exceeding 1,000, and in particular in the order of 2,000, compared to those of conventional mechanical resonators with a balance and balance spring, which are generally in the order of 280. The energy to be supplied to the resonator at each alternation is thus much lower, for example 20 times lower.

The energy transiting via the escapement is thus relatively much lower. This requires the escapement components to be arranged with reduced inertias. This feature is achieved, on the one hand, by using low-density materials such as silicon for example, or similar materials, and on the other hand by reducing the size of the escapement components. Silicon (or one of its oxides, or even any other micro-machinable material now common in the horological field) can advantageously be machined with one of the technologies derived from electronics such as "Deep Reactive Ion Etching" (DRIE), which procure a precision level adapted to the operating constraints of such an escapement. Silicon naturally undergoes oxidation in air but can be oxidised during the manufacturing process so as, for example, to increase the toughness of the components or modify the thermoelastic coefficient thereof. The controlled growth of silicon dioxide $SiO_2$ in particular allows for the prestressing of thin strips, and the creation of bistable or multistable components.

Silicon oxide (silica) is known for its tendency to absorb water. This hygroscopic property is also used to dry air for certain conditionings to prevent the goods transported therein from becoming altered by humidity (for example in the form of silica-gel packets).

In the case of mechanisms transmitting very low energies, as is the case for these new resonators, adhesion phenomena can occur. These surface phenomena can become important if the escapement components are small in size. More specifically, these surface effects (rubbing and adhesion) progressively become greater than the volume effects (inertia, mass) as the dimensions of the parts become smaller. This ultimately results in potentially detrimental bindings. The tests conducted have more specifically shown a significant efficiency loss as relative humidity increases. The adhesion forces depend on the different surface tensions and on the volume of liquid, and not on the force applied by one component to another. The influence of these bindings can result in movement stoppages when the escapement torque is low and humidity is high, which could cause power reserve losses. In the absence of any specific precautions as regards the contact surface, it can be seen that, when a watch is running in an atmosphere with more than 80% humidity, phenomena occur involving sudden drops in amplitude of the oscillator, or even the stoppage thereof, all the more so when the escapement energy is low; these phenomena can already occur with a lower humidity, in the order of 50%. It should be noted that with a low humidity, in the order of 20%, no loss of amplitude or stoppage is observed in principle.

More specifically, the energy exchanged between such a new resonator and the escapement is seen to be very low, and is only slightly greater than the energy required to release the contacting surfaces and break a lubricant meniscus. For example, the energy exchanged between the resonator mechanism and the escapement is in the order of three to ten times the energy for breaking contact. This circumstance naturally makes self-starting difficult after an unexpected stoppage, for example after an impact.

One alternative for overcoming this problem consists of depositing a hydrophobic coating on the surface of the components made of a micro-machinable material (in particular silicon and/or silicon oxide). However, owing to the operating restrictions of the escapement, this coating must be resistant to abrasion so as to guarantee long-term operation. Self-assembled, single layers or film-forming lubricants that can be surface grafted may be insufficiently resistant, and reveal the surface of the micro-machinable material, in particular silicon and silicon oxide, upon wear, making the mechanism sensitive to humidity again.

A deposition of an epilame has the drawback of ageing over time, which is why it is important to look for materials suffering as little wear as possible, for the contact surfaces of the components subjected to rubbing, such as impulse pins, darts, forks with horns, pallets, escape wheel teeth, detent pins, and similar components.

Document XP002734688, "A study of static friction between silicon and silicon compounds", by MM. Deng and Ko, describes the use of the silicon nitride-silicon pair in precision micro-mechanics, for low wear over time, and improved tribology.

Document XP002734924, "LPCVD against PECVD for micromechanical applications", by MM, Stoffel, Kovacs, Kronast, Müller, describes the use of non-stoichiometric silicon nitride, obtained by PECVD or LPCVD, to guarantee tribological properties.

International patent document WO2009/049591 filed by DAMASKO describes a method for producing mechanical functional elements of movements, in particular functional elements for oscillating clockworks, the material or the starting material whereof is chosen from a group consisting of a wide range of compounds, including silicon nitride.

U.S. patent document US2002/114225A1 filed by DAMASKO describes a clockwork, wherein the bearing journals of the balance staff, and also of the pallet-staff, have a larger diameter than in known clockworks, since a DLC coating of these bearing journals and the corresponding surfaces of the bearings provides for very low friction, which enables an increase in the bearing journal diameter without diminishing the function and accuracy. The enlargement of the bearing journal diameter results in improved shock-resistance in addition to making the elements provided for shock resistance in conventional clockworks partially, or wholly, unnecessary.

European patent document EP3327515A1 filed by ETA Manufacture Horlogère Suisse describes a timepiece regulating member comprising a free escapement mechanism with a lever, and a resonator of quality factor Q, comprising an inertial element with a pin cooperating with a fork of the lever, and subjected to the elastic return of two flexible blades, attached to the plate, which define together a virtual pivot about a main axis, the lever pivoting about a secondary axis, and the resonator lift angle (n), when the pin is in contact with the fork, is less than 10°, and the ratio I B/I A between the inertia I B of the inertial element relative to the main axis, and the inertia I A of the lever relative to the secondary axis, is greater than $2Q\cdot\alpha^2/(0.1\cdot\pi\cdot\beta^2)$, a being the lift angle of the lever corresponding to the maximum angular stroke of the fork.

European patent document EP3182213A1 filed by AUDEMARS PIGUET describes a mechanism for adjusting an average speed in a timepiece movement, which comprises an escape wheel and a mechanical oscillator, in which a plurality of blades, which are resiliently flexible in an oscillation plane, support and return a balance in such a way that this balance oscillates at an angle in the oscillation plane. A pallet-lever comprises two rigid pallets which are rigidly connected to the balance and are arranged to cooperate alternately with a toothing of the escape wheel when the balance oscillates at an angle.

SUMMARY OF THE INVENTION

The invention proposes solving the issue of the binding of the components intermittently in contact in a horological movement for a watch, comprising a new resonator with flexure bearings and a virtual pivot, the quality factor whereof exceeds 1,000, associated with an escapement mechanism.

The invention more particularly relates to the use of silicon carbide, or of engineered materials essentially comprising silicon carbide, as a high-performance tribological material in the escapement.

For this purpose, the invention relates to a horological movement for a watch, comprising a new resonator having flexure bearings and a virtual pivot, the quality factor whereof exceeds 1,000, and an escapement mechanism, with improved tribology.

The invention further relates to a method for producing such an escapement mechanism, characterised in that each pair constituted by a first rubbing surface and a second opposing rubbing surface is produced, by producing a component made of silicon carbide with a substrate for constituting said first rubbing surface and/or the second rubbing surface, either by sintering, or by solid processing.

BRIEF DESCRIPTION OF THE DRAWINGS

Other features and advantages of the invention will be better understood upon reading the following detailed description given with reference to the accompanying drawings, in which.

DETAILED DESCRIPTION OF THE PREFERRED EMBODIMENTS

Figure 1:
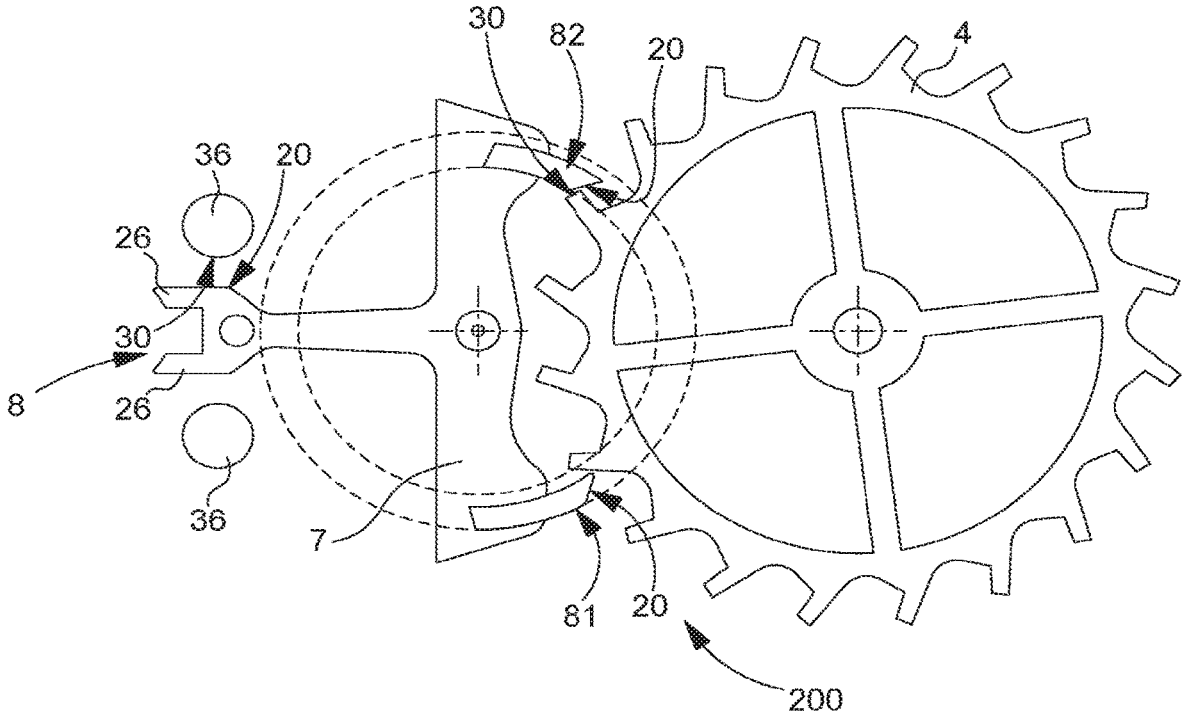
FIG. 1 diagrammatically shows a plan view of a conventional escapement mechanism comprising, in particular, a pallet cooperating and in contact with an escape wheel, at contact surfaces arranged according to the invention.
Figure 2:
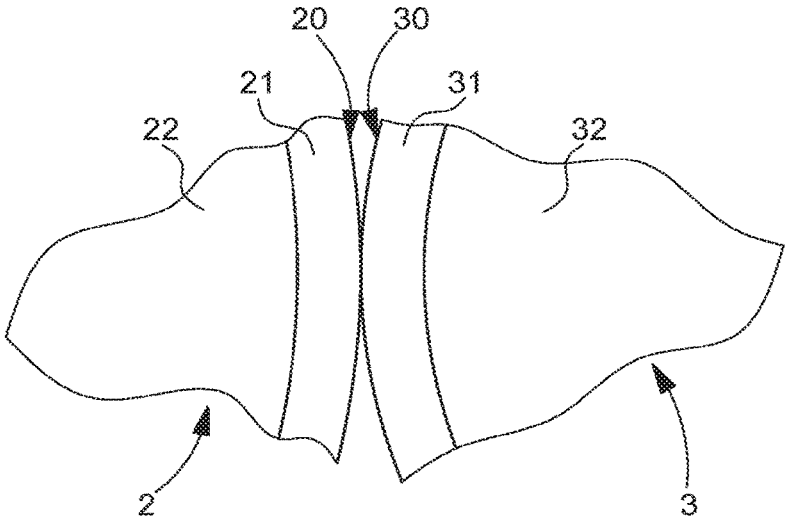
FIG. 2 diagrammatically shows the cooperation between the opposing contact surfaces.

The invention relates to the use of silicon carbide as the material permitting a horological regulator mechanism to run with minimal lubrication, comprising a resonator mechanism having flexure bearings and a virtual pivot with a high quality factor exceeding 1,000, associated with an escapement mechanism.

Lubrication-free running is a specific case. However, the features described hereinbelow are also suitable for a lubricated regulator mechanism, the advantage whereof is to be able to achieve a greater amplitude than that of a dry-running regulator with, in particular, a 10% to 20% gain in amplitude in certain cases. The regulator mechanism 300 thus preferably comprises a lubricant with a surface tension of less than 50 mN/m, and more particularly less than 40 mN/m, and even more particularly less than or equal to 36 mN/m; the surface tension of the horological lubricant used is thus significantly lower than that of water, which is equal to 72 mN/m, i.e. between about half and two thirds thereof. The invention is more particularly described for dry running, however a person skilled in the art will easily be able to extrapolate for a lubricated mechanism.

For convenience of language, "silicon carbide" will be used hereafter in the broad sense of a material which is formed:

- either of stoichiometric silicon carbide SiC, which can be solid in the most general case, or in a thin layer;
- or of a so-called non-stoichiometric composition $Si_xC_yH_z$, where x is equal to 1, y lies in the range 0.8 to 5.0, and z lies in the range 0.00 to 0.70, and more particularly in the range 0.04 to 0.70, which is preferably applied in a thin layer, but which can also form a solid component "Solid" is used herein to mean a component whose smallest dimension is greater than 0.10 mm, whereas the smallest dimension of a "thin layer" is less than 10 micrometres, and preferably less than 1 micrometre. It goes without saying that many horological components comprise areas, the smallest dimension whereof is less than 0.10 mm, such as arms or teeth of an escape wheel, or similar component; the horological components used in the case of resonators with a high quality factor are generally derived from a wafer having a thickness of greater than 0.10 mm, or from an assembly of a plurality of thinner wafers (wafer bonding) to produce a resulting wafer having a thickness of greater than 0.10 mm.

More specifically, testing has established that the rubbing of silicon carbide against silicon or silicon oxide exhibits particularly desirable properties in a horological mechanism, and more specifically in the case of an escapement mechanism.

Such a friction pair has a low coefficient of friction, less than 0.17, over a broad force—velocity range (1 mN-200 mN and 1 cm/s-10 cm/s).

The literature demonstrates that, for hard resilient materials, due to the increase in shearing stress as a function of pressure, the coefficient of friction usually varies according to a rule of type: $\mu=S/P+\alpha$, where: S is the shearing stress limit, P is the Hertz pressure and a is a parameter of constant value.

The parameter S determines the dependence of the pair on pressure, and is consequently particularly useful to consider in the case of dry rubbing in the escapement where the contact pressures and forces vary greatly, as well as at the interface between the escapement and the resonator.

In comparison to other friction pairs, the silicon carbide/Si or silicon carbide/$SiO_2$ pairs exhibit low dependence of the coefficient of friction on the normal applied force. This results in a very low parameter S. This behaviour is particularly useful in the escapement since the normal force varies greatly, typically from 0 to 200 mN during contacts and impacts. When contact is lost and made, silicon carbide maintains a low coefficient of friction of less than 0.2, a value which is usually considered to be the critical operating threshold of the escapement.

During detachments (separation of the tooth of the escape wheel on the one hand, and of the pallet stone of the lever on the other hand, for example), the adhesion forces intervene. In the case of dry running, electrostatic forces, Van der Waals forces, Hydrogen, and others have an effect. In the case of a contact with a liquid (or fluid) medium, the surface tension forces oppose the detachment and thus consume energy. In absolute terms, they cannot be considered to be friction forces. In the case of conventional regulator mechanisms having a sprung balance, they tend to be assimilated with friction forces since the adhesion forces are much lower than the friction forces, and are almost negligible when compared therewith. In the case of regulators having a high quality factor, they are of the same order of magnitude, and can even be predominant in some cases. The underlying mechanisms and the strategies for reducing friction or adhesion are different, and can even be counter-effective in certain configurations.

Moreover, the silicon carbide resists well to wear, which guarantees good strength over time.

Comparative testing with contact components made of silicon or silicon oxide shows that the use of superficial silicon carbide eliminates stoppages of the oscillator.

The invention thus relates to a horological regulator mechanism 300 comprising, arranged to be disposed on a plate 1, a resonator mechanism 100 having a virtual pivot and flexure bearing, with a quality factor Q greater than 1,000, and an escapement mechanism 200 which is arranged to be subjected to a torque from drive means 400 comprised in a movement 500, in particular for equipping a watch 1000.

Figure 3:
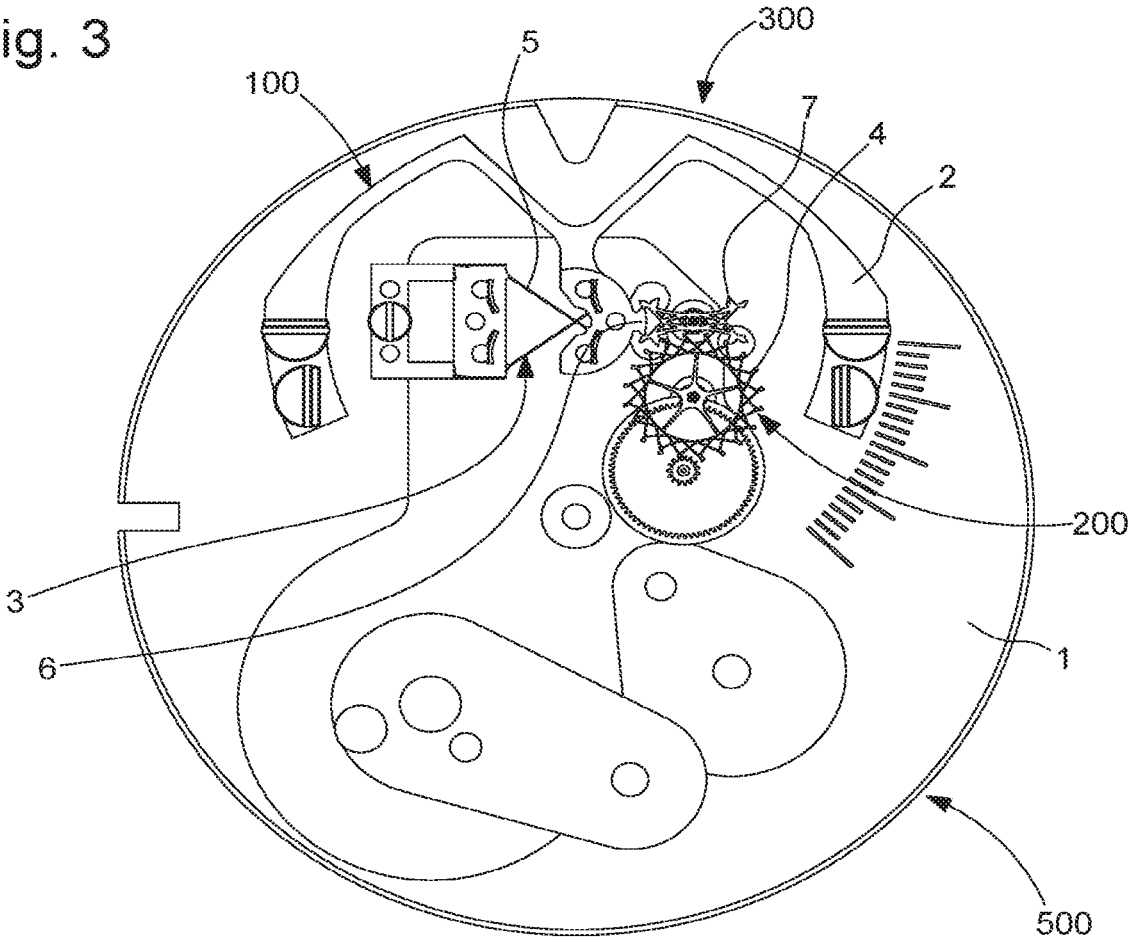
FIG. 3 diagrammatically shows a plan view of a horological regulator mechanism, according to the invention, comprising a resonator mechanism having flexure bearings and a virtual pivot with a high quality factor exceeding 1,000, comprising an oscillating inertial mass carrying an impulse pin arranged to cooperate with a fork of a pallet-lever which is moreover arranged to cooperate with the teeth of an escape wheel.
Figure 4:
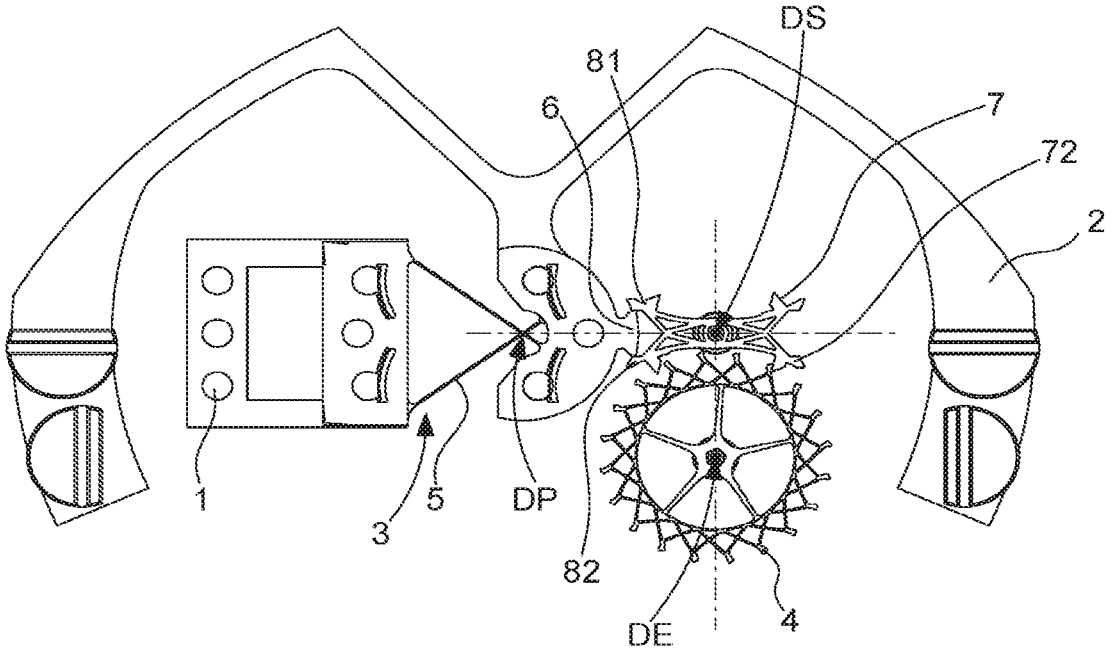
FIG. 4 shows a detailed view of FIG. 3.
Figure 5:
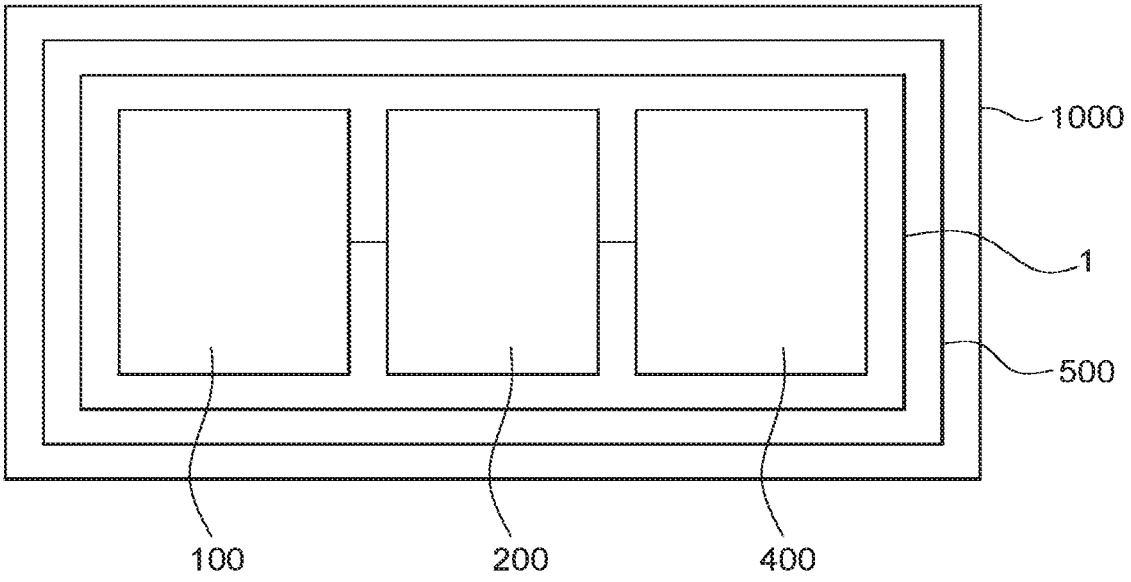
FIG. 5 shows a block diagram of a watch comprising a movement which comprises such a horological regulator mechanism, according to the invention.

For example, the regulator mechanism 300 shown in FIGS. 3 and 4 has an escapement power in the order of 0.7 microwatts, which is about twenty times lower than in the case of a conventional regulator.

The resonator mechanism 100 comprises at least one inertial element 2 arranged to oscillate relative to the plate 1. This inertial element 2 is subjected to the effect of elastic return means 3 arranged to be directly or indirectly attached to the plate 1. Furthermore, this inertial element 2 is arranged to indirectly cooperate with an escape wheel set 4 comprised in the escapement mechanism 200.

The figures show, in a non-limiting manner, an impulse pin 6 integral with an inertial mass 2, and arranged to cooperate with a pallet-lever 7, which is in turn arranged to cooperate with such an escape wheel set 4, in this case formed by an escape wheel.

This resonator mechanism 100 is, in this case, a resonator with a virtual pivot rotating about a main axis DP, with a flexure bearing comprising at least two flexible blades 5, and comprising such an impulse pin 6 integral with the inertial element 2.

The escapement mechanism 200 comprises a pallet-lever 7 pivoting about a secondary axis DS and comprising a lever fork 8 arranged to cooperate with the impulse pin 6. This escapement mechanism 200 is a free escapement mechanism, during the operating cycle whereof the resonator mechanism 100 has at least one phase of freedom in which the impulse pin 6 is at a distance from the lever fork 8.

This regulator mechanism 300 is a mechanism with improved tribology, as a function of the observations described hereinabove, and is arranged to minimise the binding phenomena between the surfaces of the components subjected to variable and/or discontinuous contact.

More particularly, this resonator 100 has a quality factor of greater than 1,000, more particularly greater than 1,800, even more particularly greater than 2,500.

The technology of virtual pivot resonators, and in particular of those having flexible blades, does not yet allow for high oscillation amplitudes of the inertial mass. In the case of the invention, the oscillation amplitude of the resonator 100 is less than 180°, more particularly less than 90°, even more particularly less than 40°.

The oscillation frequency of the resonator 100 is greater than 8 Hz, more particularly greater than or equal to 10 Hz, even more particularly greater than or equal to 15 Hz.

In a manner specific to the invention, this regulator mechanism 300 comprises, at the resonator mechanism 100 and/or the escapement mechanism 200 and/or between the resonator mechanism 100 and the escapement mechanism 200, at least one pair of components, comprising a first component 22 and a second component 32, which respectively comprise a first rubbing surface 20 and a second rubbing surface 30, which are arranged to cooperate and be in contact with one another.

For example and in a non-limiting manner, this first component 22 and this second component 32 are selected from among: impulse pin 6, pallet-lever 7, lever dart, lever fork 8 with its horns 26, pallet 72, 81, 82, escape wheel tooth 4, detent pin 36 attached to the plate, and similar components.

In one specific embodiment, all of the pairs of components subjected to variable and/or discontinuous contact of a regulator mechanism comprise opposing surfaces according to the features of the invention, at least one component 22 or 32 whereof comprises silicon carbide or the equivalent thereto, i.e. a material comprising at least 90 wt % silicon carbide SiC and at least one other material, selected from a list provided hereinbelow.

The invention more particularly relates to the case of resonator mechanisms wherein the energy to be transmitted during each impulse is less than 200 nJ.

More particularly, the invention more particularly relates to the case of resonator mechanisms wherein both the energy to be transmitted during each impulse is less than 200 nJ, and the quality factor is greater than 1,000.

The first rubbing surface 20 is the surface of a component that comprises silicon carbide which is either stoichiometric silicon carbide SiC, or non-stoichiometric silicon carbide $Si_xC_yH_z$, where x is equal to 1, y lies in the range 0.8 to 5.0, and z lies in the range 0.00 to 0.70, or even a so-called equivalent material, i.e. comprising at least 90 wt % silicon carbide SiC and at least one other material, selected from the following list, the proportions whereof are displayed per weight: alpha-SiC 6H, beta-SiC 3C, SiC 4H, fluorinated SiC, silicon carbonitride SiCN, aluminium at 400 to 2,000 ppm, iron at less than 3,000 ppm, boron and/or boron carbide $B_4C$ and/or polyphenylic boron and/or decaborane $B_{10}H_{14}$ and/or carborane $B_{10}H_{12}C_2$, the total of the materials containing boron lying in the range 0.04% to 0.14%, carbon at less than 8,000 ppm, vanadium carbide, zirconium carbide, alpha silicon oxynitride: yttrium-doped alpha-SiAlON, graphene, other impurities at less than 500 ppm.

However, the impurities are often detrimental for contact issues, and should preferably be limited to the lowest possible value, especially as regards iron which could react with the humidity to form disruptive oxides, which should be limited to less than 400 ppm. The other impurities must be limited, preferably to less than 100 ppm. Boron is only advantageous when it is made stable by a bond with another element, thus boron alone is preferably avoided.

The second rubbing surface 30 is the surface of a component that comprises at least one material ensuring good cooperation with the silicon carbide such as:

- $Al_2O_3$, or CBN, or $TiO_2$, or glass, or quartz, or diamond, or DLC;

or, according to the invention:

- or a silicon-based material selected from a group comprising silicon Si, deoxidised silicon, silicon dioxide $SiO_2$, amorphous silicon a-Si, polycrystalline silicon p-Si, porous silicon, or a mixture of silicon and silicon oxide, stoichiometric silicon nitride $Si_3N_4$, silicon nitride in a so-called non-stoichiometric composition $Si_xN_yH_z$ where x is equal to 1 and y lies in the range 0.8 to 5.0 and z lies in the range 0.00 to 0.70, oxynitrides $Si_xO_yN_z$;
- or the second rubbing surface 30 is the surface of a component that comprises at least one silicon-based material taken, as for the first rubbing surface 20, from among silicon carbide which is, either stoichiometric silicon carbide SiC, or non-stoichiometric silicon carbide $Si_xC_yH_z$, where x is equal to 1, y lies in the range 0.8 to 5.0, and z lies in the range 0.00 to 0.70, or even a material comprising at least 90 wt % silicon carbide SiC and at least one other material, selected from the following list, the proportions whereof are displayed per weight:

alpha-SiC 6H, beta-SiC 3C, SiC 4H, fluorinated SiC, silicon carbonitride SiCN, aluminium at 400 to 2,000 ppm, iron at less than 3,000 ppm, boron and/or boron carbide $B_4C$ and/or polyphenylic boron and/or decaborane $B_{10}H_{14}$ and/or carborane $B_{10}H_{12}C_2$, the total of the materials containing boron lying in the range 0.04% to 0.14%, carbon at less than 8,000 ppm, vanadium carbide, zirconium carbide, alpha silicon oxynitride: yttrium-doped alpha-SiAlON, graphene, other impurities at less than 500 ppm.

"Amorphous silicon a-Si" is understood herein to mean silicon deposited by PECVD in a thin layer, from 50 nm to 10 micrometres, of amorphous structure; it can also be hydrogenated or N-type or P-type doped.

"Polycrystalline silicon p-Si" is understood herein to mean silicon deposited by LPCVD formed of grains of microcrystalline silicon, the grain size being from 10 to 2,000 nm; it can also be N-type or P-type doped. The modulus of elasticity E is close to 160 GPa.

"Porous silicon" is understood herein to mean a material with a pore size from 2 nm to 10 micrometres, produced according to a complex manufacturing process based on anodising (HF electrolyte and an electric current).

More particularly, at least one of these first or second rubbing surfaces 20, 30 is formed, either by the surface of a solid element made of solid silicon carbide, preferably but in a non-limiting manner in the stoichiometric formulation SiC, or by the surface of a thin layer 21, 31 of silicon carbide in the stoichiometric formulation SiC, or according to a non-stoichiometric composition $Si_xC_yH_z$, where x is equal to 1, y lies in the range 0.8 to 5.0, and z lies in the range 0.00 to 0.70. More particularly, z lies in the range 0.04 to 0.70.

In the same manner as for the first component 22 with its first rubbing surface comprising silicon carbide, the second rubbing surface 30 can be either the surface of a solid component, or the surface of a thin layer.

A particularly advantageous and related application of the invention is the cooperation of the pallet stones made of SiC, in contact with the wheels made of $Si+SiO_2$.

Another advantageous application relates to the so-called "solid silicon carbide" application with wheels made of SiC, for example cut, or laser cut, or similar, which rub against a one-piece pallet-lever made of $Si+SiO_2$, or against a conventional pallet-lever provided with pallet stones made of $Si+SiO_2$.

The combinations that can be used in horology are in particular:

- wheel made of any form of $SiO_2$, solid quartz $SiO_2$, $Si+SiO_2$, cooperating with pallets made of any form of silicon carbide, in thin layers, or solid silicon carbide;
- wheels made of any form of carbide, Si+silicon carbide, solid silicon carbide, cooperating with pallets made of any form of $SiO_2$, $Si+SiO_2$, particularly solid $SiO_2$;
- the pallets can be made in one piece with the pallet-lever.

An advantageous application relates to a wheel made of oxidised Si, and pallets made of solid SiC, or pallets made of oxidised Si coated with silicon carbide.

In one advantageous embodiment of the invention, the rubbing surface 20, 30, which is the surface of a component comprising silicon carbide, is the surface of a component comprising silicon carbide SiC, or even made of silicon carbide SiC.

In particular, the first rubbing surface 20 and the second rubbing surface 30 are the surfaces of components 22 and 32 which each comprise silicon carbide or the equivalent thereto as defined hereinabove. Even more particularly, the first rubbing surface 20 and the second rubbing surface 30 are the surfaces of components which each comprise silicon carbide SiC, or which is even made of silicon carbide SiC.

In a specific alternative embodiment, the rubbing surface 20, 30, which is the surface of a component comprising silicon carbide, is a surface of a silicon carbide layer having a thickness of less than 2 micrometres. More particularly, each of the rubbing surfaces 20, 30 is the surface of a silicon carbide layer having a thickness of less than 2 micrometres.

The adhesion phenomenon concerns the surface of the material, and only at the limit of the atomic layer; however, the unavoidable abrasion phenomena make the existence of a sacrificial layer necessary, thus advantageously the rubbing surface 20, 30, which is the surface of a component that comprises silicon carbide, is a surface of a silicon carbide layer having a thickness of greater than 0.5 micrometres. More particularly, each of the rubbing surfaces 20, 30 is the surface of a silicon carbide layer having a thickness of greater than 0.5 micrometres.

Preferably, the thickness of such a silicon carbide layer lies in the range 50 to 2,000 nm. More specifically, the thickness of this so-called thin silicon carbide layer lies in the range 50 nanometres to 500 nanometres.

In a specific alternative embodiment of the invention, the rubbing surface 20, 30, which is the surface of a component comprising silicon carbide, is the surface of a silicon carbide layer, which layer covers a substrate formed of quartz or of silicon or of a silicon oxide, or of a mixture of silicon and silicon oxide. More particularly, each of the rubbing surfaces 20, 30 is the surface of a silicon carbide layer, which layer covers a substrate formed of quartz or of silicon or of a silicon oxide, or of a mixture of silicon and silicon oxide.

In a specific alternative embodiment, the rubbing surface 30, 20 opposing that 20, 30 which is the surface of a component comprising silicon carbide, is the surface of a component comprising at least one silicon-based material taken from a group comprising silicon Si, silicon dioxide $SiO_2$, amorphous silicon a-Si, polycrystalline silicon p-Si, porous silicon, and is a surface of a layer formed exclusively of one or more silicon-based materials taken from said group. More particularly, each of the rubbing surfaces 20, 30 is the surface of a component comprising at least one silicon-based material taken from a group comprising silicon Si, silicon dioxide $SiO_2$, amorphous silicon a-Si, polycrystalline silicon p-Si, porous silicon, and is a surface of a layer formed exclusively of one or more silicon-based materials taken from said group.

The SiC/Si pair gives particularly advantageous results, in that the friction torque is substantially constant, without requiring any lubrication at all. However, friction losses remain, and the choice of a fluid oil lubrication can allow these friction losses to be reduced, whereby the binding phenomena inherent to the presence of oil can be opposed by a relatively low surface tension.

Advantageously, the rubbing surface 20, 30, which is the surface of a component comprising silicon carbide, has a roughness of greater than or equal to 5 nanometres Ra, and more particularly greater than or equal to 9 nanometres Ra, even more particularly greater than or equal to 25 nanometres Ra, at least at at least one contact surface. More particularly, this rubbing surface 20, 30 has a roughness of greater than or equal to 5 nanometres Ra at each contact surface. Even more particularly, each of these rubbing surfaces 20, 30 has a roughness of greater than or equal to 5 nanometres Ra at each contact surface.

In a specific alternative embodiment, one of the two rubbing surfaces 20, 30 is smooth so as to prevent too high friction (interpenetration of the rough surfaces for example). The rough surface must undergo relative displacement with a smooth surface to prevent wear. The surface roughness of the counterpart must preferably be low to limit wear, and the roughness is advantageously less than that of the contact surface, and more particularly but in a non-limiting manner, less than 5 nanometres Ra.

In another specific alternative embodiment, to allow for supralubrication, one of the surfaces is the surface of a component which comprises a first framed raised area that is raised, for example in the form of a juxtaposition of pyramids, or similar, and the opposing surface is the surface of a component which comprises a second framed raised area, which can be similar or otherwise to the first framed raised area, however which differs by a relative inclination of the frame direction thereof with that of the first framed raised area, so as to prevent any interlocking inside one another.

The invention further relates to a method for producing such an escapement mechanism 200.

According to this method:

- in a first alternative, a layer of silicon carbide is applied to a substrate to form one of these first or second rubbing surfaces 20, 30:
  - either by plasma enhanced chemical vapour deposition PECVD,
  - or by chemical vapour deposition CVD, or by cathodic sputtering;

or in a second alternative, deep etching is performed on the component in a solid bulk of silicon carbide.

These alternative embodiments are not exclusive, they are the most cost-effective. SiC growth can also be carried out in a sacrificial silicon mask, however this operation is difficult and costly. A silicon wafer can also be carburised (or nitrided if looking to obtain $Si_3N_4$ for one of the opposing surfaces), however it is difficult to control the deformation of the lattice, which can lead to dislocation or a noteworthy dimensional modification.

More specifically, a silicon carbide component is produced with a substrate to form the base of one of the first or second rubbing surfaces 20, 30, either by sintering, or by solid processing.

In particular, for the deposition of a layer comprising silicon carbide, or formed of silicon carbide, one or more of the technologies known to a person skilled in the art specialised in "MEMS" can be used: LPCVD (low-pressure chemical vapour deposition), PECVD (plasma-enhanced chemical vapour deposition), CVD (chemical vapour deposition at atmospheric pressure), ALD (atomic layer deposition), cathodic sputtering, ion implantation and similar processes.

Preferably, a Si/C ratio that lies in the range 0.8 to 1.2 is chosen. More specifically, the Si/C value of 1 is stoichiometric.

Preferably, in the case of $Si_xC_yH_z$, a hydrogen concentration that lies in the range 2 to 30% H is chosen.

Preferably, in a non-limiting manner, an ordinary Si substrate is chosen.

As regards the sub-layer, in a non-limiting manner, $SiO_2$ can be chosen, typically with a thickness that lies in the range 50 to 2,000 nm, or poly-Si, SiC, or a similar material can be chosen.

The technological limitations related to silicon carbide deposition are known to a person skilled in the art in the field of MEMS.

Thus, the thickness of a silicon carbide layer preferably lies in the range 50 to 2,000 nm.

As regards the state of compression of silicon carbide, it is known to a person skilled in the art specialising in "MEMS" that the increase in concentration of Si reduces the tensions in silicon carbide and can even make it compressive. It is known that the materials having a compressive stress generally result in reduced frictional wear. This corresponds to Si-rich silicon carbide. However, the oxidation of too much of the surface silicon into silicon oxide should be prevented, since this recreates an adhesion phenomenon that we are looking to prevent.

For proper implementation of the invention, it is important for the silicon carbide layer to adhere properly to the substrate, and for the elastic moduli of the materials not to be too far apart. The nature of the underlying materials is less important. If the silicon carbide layer exceeds a thickness of close to 200 nm, to prevent wear from causing the appearance of the silicon too quickly, which is quickly oxidised into silicon oxide, which is detrimental for adhesion, friction is determined by the very first peripheral nanometres of this silicon carbide layer.

Pallets made of one-piece SiC can be produced by the same techniques as those used for the manufacture of polycrystalline ruby pallet-stones, known to a person skilled in the art.

Furthermore, it is advantageously possible to consider solid silicon carbide rubbing against Si or $SiO_2$, for example for a silicon carbide pallet against a wheel made of $SiO_2$.

The invention has numerous advantages in the case of non-lubrication of the escapement:

low dependence of the coefficient of friction on the friction velocity. This is particularly useful in the case of the escapement since the velocity typically varies between 0 and 3 cm/s.

a stable coefficient of friction as a function of the velocity and pressure reduces the risk of the appearance of stick-slip which generally results in accelerated degradation of the rubbing materials.

no risk of forming a third body adverse to friction.

low chemical reactivity of silicon carbide, particularly in its stoichiometric form SiC, making it relatively insensitive to cleaning, degradation, or interaction with the surrounding environment.

low wear.

It should be noted that the solution proposed by the invention is dedicated to reducing adhesion phenomena (separation/normal displacement and tangential displacement) which are different from the friction phenomena (tangential displacement only).

Silicon carbide also has the advantage of being simple to implement, particularly by PECVD conformal coating, particularly on silicon or silicon oxide. This method of deposition is widely known and used in the silicon industry.

The present invention allows for the use of silicon carbide in various forms: deposition by PECVD, CVD, cathodic sputtering, solid, sintered, and other forms.

Related applications of the invention include rubbing of the silicon carbide against non-limiting partners, such as: Si, $SiO_2$, amorphous silicon a-Si, polycrystalline silicon p-Si, and porous silicon.

The invention solves the problem of binding which until now hindered the development and industrialisation of regulator mechanisms for watches with a quality factor of greater than 1,000, and it is understood that improvements can also be made as regards other horological problems. For example, the contact between the pin and the fork of the pallet-lever in a conventional mechanism is also subjected to bindings. More generally, this solution can be applied to all cases where the energy levels in play are low.

The invention claimed is:

1. A horological regulator mechanism arranged on a plate, the regulator mechanism comprising:

a resonator mechanism having a virtual pivot, about a main axis, and flexure bearing, with a quality factor Q greater than 1,000, and an escapement mechanism which is arranged to be subjected to a torque from drive means comprised in a movement, said resonator mechanism comprising an inertial element arranged to oscillate relative to said plate, said inertial element being subjected to the effect of elastic return means arranged to be directly or indirectly attached to said plate, and said inertial element being arranged to indirectly cooperate with an escape wheel set comprised in said escapement mechanism, said escapement mechanism being free and, during the operating cycle thereof the resonator mechanism having at least one phase of freedom in which it is not in contact with said escapement mechanism, an oscillation amplitude of the resonator mechanism being less than 180°, an oscillation frequency of the resonator mechanism being greater than 8 Hz, said regulator mechanism comprising at least one pair of components comprising a first component and a second component respectively comprising a first rubbing surface and a second rubbing surface arranged to cooperate and be in contact with one another, wherein said first component comprises, at said first rubbing surface thereof, silicon carbide which is either stoichiometric silicon carbide SiC, or non-stoichiometric silicon carbide $Si_xC_yH_z$, where x is equal to 1, y lies in the range 0.8 to 5.0, and z lies in the range 0.00 to 0.70, or a material comprising at least 90 wt % silicon carbide SiC and at least one other material selected from the following list, proportions whereof are displayed per weight: alpha-SiC 6H, beta-SiC 3C, SiC 4H, fluorinated SiC, silicon carbonitride SiCN, aluminium at 400 to 2,000 ppm, iron at less than 3,000 ppm, boron and/or boron carbide $B_4C$ and/or polyphenylic boron and/or decaborane $B_{10}H_{14}$ and/or carborane $B_{10}H_{12}C_2$, the total of the materials containing boron lying in the range 0.04% to 0.14%, carbon at less than 8,000 ppm, vanadium carbide, zirconium carbide, alpha silicon oxynitride: yttrium-doped alpha-SiAlON, graphene, other impurities at less than 500 ppm, wherein said second component comprises, at said second rubbing surface thereof, at least one silicon-based material selected from a group comprising silicon Si at less than 400 ppm by weight, deoxidised silicon, silicon dioxide $SiO_2$ at less than 8,000 ppm by weight, amorphous silicon a-Si, polycrystalline silicon p-Si, porous silicon, or a mixture of silicon and silicon oxide, stoichiometric silicon nitride $Si_3N_4$, silicon nitride in a so-called non-stoichiometric composition $Si_xN_yH_z$ where x is equal to 1 and y lies in the range 0.8 to 5.0 and z lies in the range 0.00 to 0.70, oxynitrides $Si_xO_yN_z$; or at least one silicon-based material which is either stoichiometric silicon carbide SiC, or non-stoichiometric silicon carbide $Si_xC_yH_z$, where x is equal to 1, y lies in the range 0.8 to 5.0, and z lies in the range 0.00 to 0.70, or a material comprising at least 90 wt % silicon carbide SiC and at least one other material, selected from the following list, the proportions whereof are displayed per weight:

alpha-SiC 6H, beta-SiC 3C, SiC 4H, fluorinated SiC, silicon carbonitride SiCN, aluminium at 400 to 2,000 ppm, iron at less than 3,000 ppm, boron and/or boron carbide $B_4C$ and/or polyphenylic boron and/or decaborane $B_{10}H_{14}$ and/or carborane $B_{10}H_{12}C_2$, the total of the materials containing boron lying in the range 0.04% to 0.14%, carbon at less than 8,000 ppm, vanadium carbide, zirconium carbide, alpha silicon oxynitride: yttrium-doped alpha-SiAlON, graphene, other impurities at less than 500 ppm, and wherein a surface roughness of at least a contact surface of at least one of the first and second rubbing surfaces is greater than or equal to 5 nanometers Ra.

2. The regulator mechanism according to claim 1, wherein each of said first component and said second component comprises silicon carbide which is either stoichiometric silicon carbide SiC, or non-stoichiometric silicon carbide $Si_xC_yH_z$, where x is equal to 1, y lies in the range 0.8 to 5.0, and z lies in the range 0.00 to 0.70, or even a material comprising at least 90 wt % silicon carbide SiC and at least one other material, selected from the following list, the proportions whereof are displayed per weight: alpha-SiC 6H, beta-SiC 3C, SiC 4H, fluorinated SiC, silicon carbonitride SiCN, aluminium at 400 to 2,000 ppm, iron at less than 3,000 ppm, boron and/or boron carbide $B_4C$ and/or polyphenylic boron and/or decaborane $B_{10}H_{14}$ and/or carborane $B_{10}H_{12}C_2$ the total of the materials containing boron lying in the range 0.04% to 0.14%, carbon at less than 8,000 ppm, vanadium carbide, zirconium carbide, alpha silicon oxynitride: yttrium-doped alpha-SiAlON, graphene, other impurities at less than 500 ppm.

3. The regulator mechanism according to claim 2, wherein said first component and said second component each comprise silicon carbide.

4. The regulator mechanism according to claim 1, wherein said second rubbing surface is formed by the surface of a solid element made of solid silicon carbide.

5. The regulator mechanism according to claim 4, wherein said second rubbing surface is formed by the surface of a solid element made of solid silicon carbide in the stoichiometric formulation SiC.

6. The regulator mechanism according to claim 1, wherein said regulator mechanism is devoid of lubricant.

7. A horological movement comprising at least one regulator mechanism according to claim 1.

8. A watch comprising at least one horological movement according to claim 7.

9. A method for producing a regulator mechanism according to claim 1, wherein each pair formed by a first rubbing surface opposing a second rubbing surface comprising silicon carbide is produced, and wherein a component made of silicon carbide is produced with a substrate to form said first rubbing surface and/or said second rubbing surface by sintering.

10. The method for producing a regulator mechanism according to claim 1, wherein each pair formed by a first rubbing surface opposing a second rubbing surface comprising silicon carbide is produced, and wherein a component made of silicon carbide is produced with a substrate to form said first rubbing surface and/or said second rubbing surface by processing in the form of a solid component, the thickness of the solid component is greater than 0.10 mm.

11. The regulator mechanism according to claim 1, wherein an escapement power of said regulator mechanism is on an order of 0.7 microwatts.

* * * * *